United States Patent [19]

Bain

[11] Patent Number: 5,038,680

[45] Date of Patent: Aug. 13, 1991

[54] PRINTING PRESS BLANKET CYLINDER ASSEMBLY AND METHOD OF MAKING SAME

[75] Inventor: Lawrence J. Bain, LaGrange, Ill.

[73] Assignee: Rockwell International Corporation, El Segundo, Calif.

[21] Appl. No.: 452,914

[22] Filed: Dec. 18, 1989

[51] Int. Cl.[5] ..... B41F 30/04; B41F 27/02; B41F 5/00

[52] U.S. Cl. ..... 101/401.1; 101/217; 101/389.1; 101/483; 101/494

[58] Field of Search ..... 101/389.1, 401.3, 217, 101/142, 483, 484, 492, 494, 378, 375

[56] References Cited

U.S. PATENT DOCUMENTS

| | | | |
|---|---|---|---|
| 2,774,302 | 12/1956 | Stromme | 101/389.1 X |
| 3,395,638 | 8/1968 | Kirkus | 101/216 |
| 3,496,866 | 2/1970 | Nystrand | 101/389.1 X |
| 3,670,646 | 6/1972 | Welch, Jr. | 101/389.1 |
| 3,765,329 | 10/1973 | Kirkpatrick et al. | 101/415.1 |
| 4,125,073 | 11/1978 | Bain | 101/216 |
| 4,403,549 | 9/1983 | Matuschke | 101/415.1 |
| 4,466,349 | 8/1984 | Bartlett | 101/220 |
| 4,577,560 | 3/1986 | Banike | 101/415.1 |
| 4,648,318 | 3/1987 | Fischer | 101/378 X |
| 4,742,769 | 5/1988 | Zeller | 101/216 |
| 4,817,527 | 4/1989 | Wouch et al. | 101/389.1 |
| 4,823,697 | 4/1989 | Randazzo | 101/389.1 X |

*Primary Examiner*—Clifford D. Crowder
*Attorney, Agent, or Firm*—C. B. Patti; V. L. Sewell; H. F. Hamann

[57] ABSTRACT

A pair of coacting blanket cylinder assemblies (13', 14') employed in a high speed printing press are each provided with a resilient blanket (13, 14) wrapped around a cylinder (15, 16) and held in place by magnets (35, 26) carried by the cylinders (15, 16). The magnets (35, 36) attract and hold magnetic portions (31, 32, 33, 34) of a metal backing plate adjacent the ends of the blankets (13A, 13B, 14A, 14B) which are separated by a gap (43, 44) of a size selected according to the thickness of blanket and natural frequency of the cylinder (15, 16) to obtain a residual response for gap disturbances that is less than a maximum threshold response at which streaking occurs during printing operation at high speed.

34 Claims, 4 Drawing Sheets

P
2
1.5
1
0.5
0.3
0.1
0.2
0.3
0.4
2ωQ/V
86
87
88
89
90
91
A

P
5
4
3
2
1
0
-1
-2
-3
-4
-5
2
2ωQ/V
75
76
77
78

PRINTING PRESS BLANKET CYLINDER ASSEMBLY AND METHOD OF MAKING SAME

BACKGROUND OF THE INVENTION

This invention relates to printing press apparatus and methods of operation thereof and more particularly, to a blanket cylinder assembly and method of making same to reduce gap disturbances over a range of high speeds to a level beneath a threshold level at which streaking is caused during printing operations.

The performance boundaries of web-fed rotary printing presses have traditionally been limited by the phenomenon of "streaking" in the form of partial or complete ink discontinuities which extend along one or more lines parallel to one another and transverse to the direction of travel of paper. It is known that this phenomenon is the result of transient vibrations of the printing cylinders induced by the repetitive passage of surface discontinuities through the line of contact between coacting cylinders. Such discontinuities are present in lithographic process printing presses as a consequence of the need for removable, image-carrying plates and for removable, resilient blankets used for image offsetting to the paper or for impression support behind the paper when printing is done directly from the plate. Various mechanisms are known which secure the ends of plates and blankets to the cylinders that require some space for insertion and removal of the ends which disallows a continuous surface around the cylinder circumference.

In contrast, rotogravure presses operate with the image engraved directly into the cylinder surface. This permits a continuous surface, and thus rotogravure presses do not exhibit the streaking phenomenon. Unfortunately, when the image has to be changed, the entire cylinder must be removed from the press.

A typical printing press of the general type to which this invention relates will exhibit an increasing tendency to produce streaked printing as the rate of cylinder rotation, or press speed, increases. Thus some maximum operating speed is established at which streaking is not observable or not intense enough to cause rejection of the printed product. Observation of the behavior of such a press has lead others to the conclude that streaking is a monotonic function of press speed. Based on this conclusion, certain actions have been taken by others to provide a greater range of acceptable press performance as it is judged in regard to streaking.

Attempts have been made to reduce the severity of the disturbance created by the passage of the cylinder discontinuity. Kirkus teaches in U.S. Pat. No. 3,395,638 that this can be accomplished by gradually reducing the cylinder radius as the discontinuity is circumferentially approached from either direction. This has the effect of reducing the time dependent force derivatives that contribute to the imposed disturbance. An expedient method used to emulate this effect is to "feather" the sheets of paper that are placed between the blanket cylinder body and the blanket to obtain the correct overall dimension for printing. Feathering is the process of placing several such sheets of paper on the cylinder which are cut to different lengths so the effective radius of the blanket cylinder is reduced in the vicinity of the discontinuity location. Bartlett teaches in U.S. Pat. No. 4,466,349 that designing the cylinder so that the line of the discontinuity is at an angle of skew relative to the axis of cylinder rotation will reduce the disturbing effect by allowing the discontinuity to pass through the line of contact progressively from one end of the cylinder to the other instead of along the entire cylinder at one time.

These two approaches to disturbance magnitude reduction have not found widespread use for two reasons. One is that the attempt to reduce the pressure gradient in the vicinity of the discontinuity also necessarily reduces the pressure available to affect ink transfer and therefore places a limit on the cylinder circumference which can actually be used for printing. The second reason is that manufacturing variable radius cylinders and skewed discontinuities is more complicated and thus more costly than manufacturing conventional cylinders. The feathered packing approach adds complexity to press operation and thus increases the variable cost of print production.

Attempts have been made to counter the streaking effect by providing a damping mechanism to more rapidly dissipate the energy imparted to the cylinders by the discontinuity. In U.S. Pat. No. 4,125,073 to the present inventor, an impact damper is incorporated into a cylinder to create a process of momentum transfer which prevents persistent transient oscillation of the cylinder following a disturbance. While such a damper has great advantage, it is difficult to manufacture because of the precise tolerances required for optimal performance and is also subject to wear which reduces its effectiveness over time.

The failure of these attempts to provide a completely satisfactory solution to the streaking problem has led some in the industry to believe that the problem must be solved by eliminating the discontinuity in the cylinder surfaces. This way of thinking implies that any discontinuity, however small, will ultimately produce the streaking phenomenon if the press is run at a high enough speed. Kirkpatrick and Warll in U.S. Pat. No. 3,765,329; Matuschke in U.S. Pat. No. 4,403,549; Banike in U.S. Pat. No. 4,577,560 and Zeller in U.S. Pat. No. 4,742,769 teach methods for complete elimination of discontinuities. However, in applying these methods extreme precision in the gross dimensions of the removable plates and blankets is required if the intention is to make the ends of these elements meet in full contact over the length of the cylinders, but such precision is inconsistent with the normal operating environment of a printing facility. Alternatively, providing means for sealing a residual gap when the ends of the elements cannot be made to meet perfectly complicates the installation and removal processes and thus increases the time and cost associated with preparing a press for operation.

SUMMARY OF THE INVENTION

It is therefore the general object of the invention to provide apparatus and methods which overcome the aforementioned problems of the prior art in order to achieve reliable operation of presses at high speeds to produce a printed product which is free of streaks and otherwise of high quality. With the preferred embodiment of the blanket cylinder assembly of the present invention, such results are readily and economically obtained in practice to minimize the technical skills and attention required on the part of press operators and to reduce the likelihood of errors and costly mistakes.

The invention is based in part upon an analysis of printing press operations and upon the premise that the conclusions which have been reached by others through observation of printing press behavior are incorrect. It is found that contrary to the prior art teachings, the streaking phenomenon is not a monotonic function of press speed. The invention provides a method based upon quantitative design parameters by which a gap of preselected size is provided in the printing surfaces which reduces the tendency for increased gap disturbances with increased press speed. This discovery is based on a theoretical analysis which at first appears contrary to the empirical knowledge that can be derived from practical experience with contemporary printing presses, but which upon closer inspection shows that the problem of streaking caused by gap disturbance has finally been solved.

The invention will be best understood with reference to lithographic process printing presses. In such presses, ink transfer from one surface to another, for example from the plate to the blanket in an offset lithographic press, is dependent upon the presence of pressure, typically in the range of five hundred pounds per square inch. This pressure allows the adhesive bond between the ink and a surface to overcome the cohesive property of the ink and to thus split the ink film so that each of the two surfaces on a pair of coacting rollers or cylinders carries a portion of the original ink film. The pressure required to affect this ink film splitting is created by causing each pair of rotating elements to have a distance between their corresponding axes of rotation which is less than the sum of the radii of the two elements when they are not in contact with one another. This is accomplished by making one element of the pair with a hard surface, e.g., the plate, and the other element with a resilient surface, e.g., the blanket. The characteristic force-deflection curve of the resilient blanket determines the amount of pressure that will be present along the line of contact between the two rotating elements.

Taking the coacting plate and blanket cylinders as an example, the forces created by compression of the resilient blanket will also cause deflections of the cylinders themselves, generally bending in a direction perpendicular to the axis of rotation. The cylinder deflections are obviously much smaller than the deflection of the resilient blanket material, but the potential energy stored in the cylinders as a result of these deflections is significant because of the high modulus of elasticity in the material of the cylinders proper, which are typically made of steel.

When the force between the cylinders is altered, as a result of the passage of a surface discontinuity through the line of contact, the potential energy in the cylinders is transformed into kinetic energy and a transient oscillatory condition arises which persists until dissipative reactions restore the original equilibrium condition. The pressure along the line of contact between the cylinders varies during the period of transient oscillations as the result of changes in the deflection of the resilient blanket. As a consequence, the amount of ink transferred from the plate to the blanket also changes.

The surface discontinuities on coacting cylinders are geometrically arranged on a press where there is one circumferential discontinuity per cylinder such that the discontinuity on one cylinder meets with the discontinuity on the other cylinder in the line of contact. In a so-called perfecting press, which applies ink to both sides of the paper at the same time, the plate and blanket cylinders delivering ink to each side coact, and the two blanket cylinders coact with the paper between them.

As a result, the blanket cylinders experience two direct pressure disruptions, and the plate cylinders experience one direct pressure disruption. The plate cylinders also experience an indirect pressure disruption when the blanket cylinder discontinuities meet.

In accordance with the present invention, analyses generally applicable to the response of oscillatory systems to pulse-like disturbances has been applied to printing press systems to obtain a design for cylinder assemblies which enable stable, reliable and streak-free operation at high press speeds on the order of speeds of 40,000 cylinder revolutions per hour or higher. A detailed analysis, which is verified by results of actual press operations, shows that a gap size can be selected which will cause oscillatory movements of a cylinder to be no greater at high speed, such as a speed of 40,000 cylinder revolutions per hour, than at a low speed, such as a speed of 15,000 cylinder revolutions per hour. Thus by choosing right sized gaps, high speed printing can be achieved without streaking and with otherwise high quality and, at the same time, in a very practical manner. A high degree of precision is not required to achieve the correct gap size and the desired results are readily obtained.

In accordance with the invention, a gap is provided between end portions of a blanket wrapped around a blanket cylinder of a preselected size based on a relationship between certain parameters to limit oscillations at high press speeds and prevent streaking. Such parameters include one or more of the natural frequency of vibration of the blanket cylinder, the thickness of the blanket and the type of forces holding the adjacent ends of the blanket to the cylinder.

It is therefore an object of the invention to provide a blanket cylinder assembly comprising a cylinder having a natural bending frequency, a blanket with a pair of opposite ends and a preselected thickness and means for mounting the blanket wrapped around the cylinder with a stress free boundary condition at the opposite ends with a preselected gap therebetween. The stress-free boundaries cause the rise and decay times of disturbances associated with the gap to be substantially determined by said thickness of the blanket, and said gap has a dimension relative to the thickness to provide a response level to gap disturbances at a preselected relatively high speed which is less than a given threshold response level at which streaking is caused thereby at said speed.

It is also an object to provide a method of making a blanket cylinder for a printing press operable at a preselected relatively high speed, comprising the steps of providing a cylinder with a circumference of given size and a natural frequency in bending, providing a blanket with a given thickness and a length measured between a pair of opposite ends thereof which is less than the circumference of the cylinder by an amount to produce, when wrapped around the cylinder, a corresponding gap between the opposite ends of a size which is selected based in part on (a) said thickness, (b) the forces securing the blanket to the cylinder at said opposite ends and (c) said natural frequency to achieve a response level to gap disturbances that is less than a given threshold response level which causes streaking at said speed and securing the blanket wrapped around said cylinder with the preselected gap.

BRIEF DESCRIPTION OF THE DRAWINGS

The foregoing objects and advantageous features of the invention will be described in greater detail and further advantageous features of the invention will be made apparent from the detailed description of the preferred embodiment which will be given with reference to the several figures of the drawing in which.

DETAILED DESCRIPTION

Figure 1:
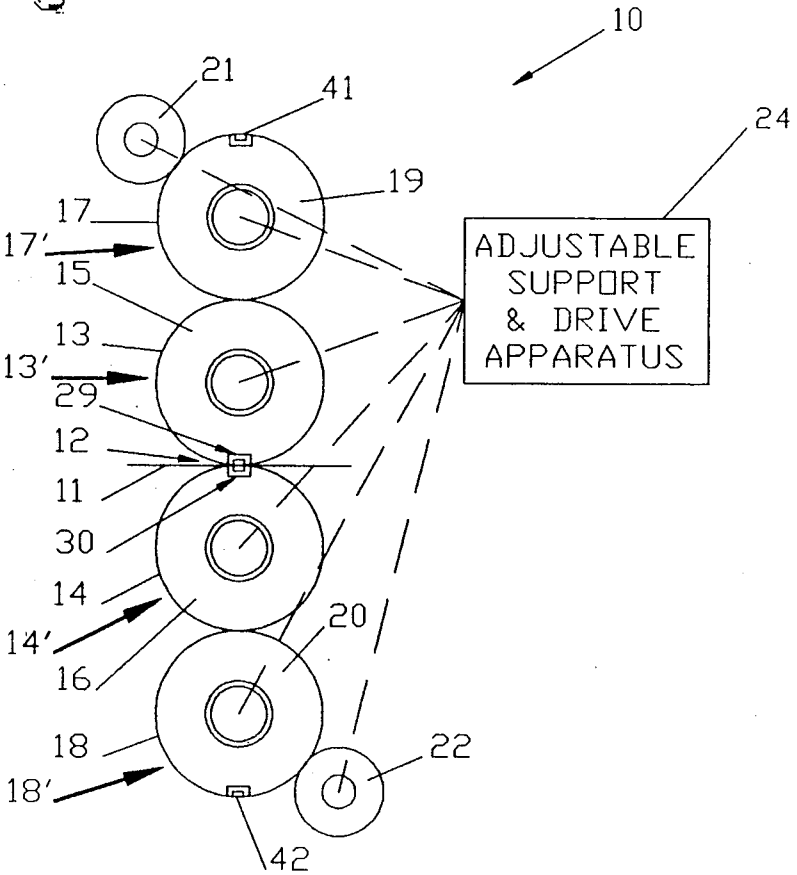
FIG. 1 is a schematic side elevation of a printing press incorporating the preferred embodiment of the blanket cylinder assembly of the present invention.

Referring to FIG. 1, an offset printing press 10 has a nip region 12 within which printing contact is effected between opposite sides of a paper web, or paper, 11 and a pair of substantially identical blanket cylinder assemblies 13' and 14' of the present invention. Blanket cylinder assemblies 13' and 14' comprise blankets 13 and 14, respectively, which are wrapped around the circumferences of blanket cylinders 15 and 16, respectively. Ink impressions on the blankets 13 and 14 are thereby transferred to the opposite sides of the paper 11 in the nip region 12 at an engagement plane intersecting the axes of the blanket cylinders 15 and 16.

Ink is applied to the blankets 13 and 14 from inked printing plate cylinder assemblies 17' and 18'. Plate cylinder assemblies 17' and 18' comprise printing plates 17 and 18, respectively, which are wrapped around plate cylinders 19 and 20, respectively. Plate cylinder 19 and 20 are mounted for rotation about axes in coplanar and spaced parallel relation to the axes of blanket cylinders 15 and 16. The lines of contact between blankets 13 and 14 and plates 17 and 18 are thereby in the aforementioned engagement plane intersecting the cylindrical axes and are preferably, although not necessarily, diametrically opposite the nip region 12 through which the paper 11 passes. Ink and damping mediums are applied to the printing plates 17 and 18 from rollers, such as rollers 21 and 22 as diagrammatically illustrated.

Axial shafts of the blanket cylinders 15 and 16 and the plate cylinders 19 and 20 are supported and driven by an adjustable support and drive apparatus 24. The apparatus 24 is adjustable to control the distance between the axes of the blanket cylinders 15 and 16 and also the distances between the axes of the blanket cylinders 15 and 16 and those of the plate cylinders 19 and 20. The pressure applied from the blankets 13 and 14 to the paper 11 and the pressures applied from the plates 17 and 18 to the blankets 13 and 14 is controlled by controlling the distances between the axes.

The blankets 13 and 14 are of a conventional resilient blanket material and are compressed to effect transfer of ink therefrom to the opposite sides of the paper 11 and to effect transfer from the plates 17 and 18 to the blankets 13 and 14. Such resilient compression is achieved by positioning the axes of the blanket cylinders 15 and 16 at a distance from each other which is less than the sum of the diameter and the thickness of the blanket and by similar positioning of the axes of the plate cylinders 19 and 20 relative to the axes of the blanket cylinders 15 and 16.

It is also necessary that each of the plates 17 and 18 and blankets 13 and 14 be mounted securely to their respective cylinders with opposite ends securely attached thereto during operation by means which facilitates their easy removal as needed. As explained below with reference to FIG. 2, this is accomplished by means which avoids the extreme pressure variations that have caused oscillations of the cylinders and streaking, especially at high production speeds, in prior art devices.

Figure 2:
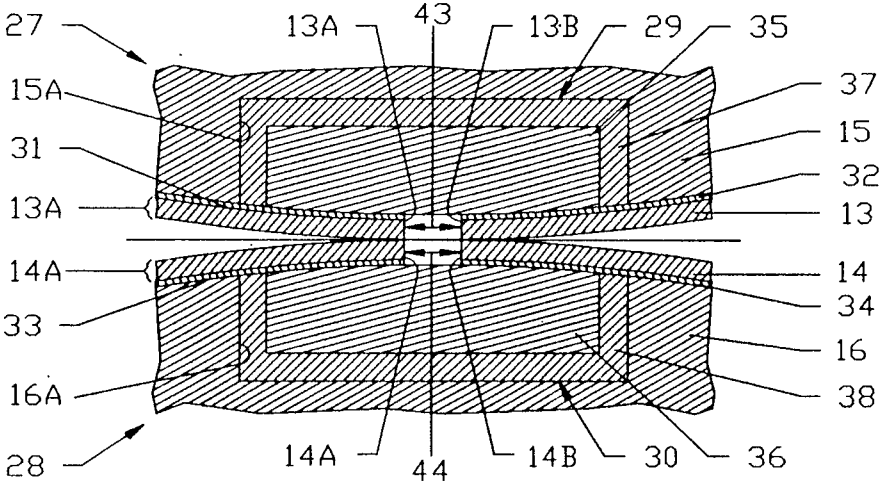
FIG. 2 is a sectional side view, on an enlarged scale, of the blanket mounting means of two of the blanket cylinders of FIG. 1.

Referring to FIG. 2, securing arrangements 27 and 28 mount the blankets 13 and 14 wrapped around the respective blanket cylinders 15 and 16. In accordance with the present invention, the lengths of the blankets 13 and 14 are chosen to be less than the circumference of the cylinders about which they are wrapped by a preselected amount. This creates gaps 43 and 44 between opposite leading and trailing ends 13A and 13B and 14A and 14B of blankets 13 and 14, respectively, of preselected size. The gap size is selected according to an analysis based in part on the natural bending frequency of the cylinders 15 and 16, the thicknesses 13A and 14A of blankets 13 and 14, respectively, and the forces holding the ends of the blanket to their associated cylinders.

With respect to such holding forces, preferably the blankets 13 and 14 are secured to their respective cylinders by means which provides a stress-free boundary condition on the leading and trailing ends 13A, 13B, 14A and 14B. That is, unlike the prior art mounting devices, the opposite ones of the blankets are not locked together or locked in a slot at a fixed angular position. Instead, the ends can freely distort inwardly toward the center of the gaps 43 and 44. Although, adhesive, electrostatic or other means could be employed, the preferred stress free mounting means employs magnetically attractive members respectively carried by the associated cylinder and blanket. This facilitates reliably relating the optimum size of the gap to the thickness of the resilient blanket over a range of speeds for streakless printing.

In a preferred embodiment, permanent magnet structures 29 and 30 are carried in sockets 15A and 16A of the blanket cylinders 15 and 16. Mounting structure 29 is arranged to magnetically attract and securely hold a pair of backing plates with portions 31 and 32 of magnetic material, such as magnetic stainless steel, located at opposite ends of a single backing plate of blanket 13 and which are positioned under resilient layers of the blanket 13 adjacent the end edges 13A and 13B. Similarly, mounting structure 30 is arranged to magnetically attract and securely hold a pair of backing plate portions 33 and 34 of magnetic material at opposite ends of the plate of blanket 14 and which are positioned under the resilient ply, or layer, of the blanket 14 adjacent the end edges 14A and 14B. Preferably, the backing plates, or inner plys, are coextensive with the resilient outer layers, while the magnetic portions 31 and 32 only need to be located at the ends.

Mounting structures 29 and 30 preferably include permanent magnet members 35 and 36 within liners 37 and 38 of nonmagnetic material interposed between the magnet members 35 and 36 and the cylinders 15 and 16 which are desirably of steel. Each of mounting structures 29 and 30 preferably include a plurality of the magnet members 35 and 36 in axially spaced relation across the length of the cylinder. The material for the backing plate is preferably stainless steel with the end portions 31, 32, 33 and 34 being integrally formed portions of magnetic stainless steel. The magnets are preferably permanent magnets, but electromagnets could be employed to facilitate removal. In any event, the magnets are of sufficient strength to permeate the ferromagnetic portions of the backing plate sufficiently to firmly secure the blanket to the cylinder.

Plate mounting mechanism 41 and 42 in FIG. 1 used for securing the ends of the plates 17 and 18 to the respective plate cylinders 19 and 20 preferably have constructions similar to those of the blanket securing arrangements 27 and 30, but the details of the plate mounting apparatus 41 and 42 do not form any part of this invention.

As depicted in FIGS. 1 and 2, the cylinders 15 and 16 are in a position in which the gaps 43 and 44 are in register with each other in the engagement plane with the securing arrangements 41 and 42 of the plate cylinders 19 and 20 being diametrically aligned with the portions of plates 17 and 18 which are engaged with the blankets 13 and 14. In the position as shown, the forces exerted on the blanket cylinders 15 and 16 as a result of compression of the blankets 13 and 14 are at a minimum. The forces are at a maximum when continuous portions of the blankets 13 and 14 are in the engagement plane.

Prior to reaching the position shown, the forces exerted on the cylinders 15 and 16 are decreased to a certain level at which they may be maintained level for a certain dwell time, and then the forces are increased back to the normal condition. The disturbance, or gap disturbance, from such force variations may thus be considered as including an initial rise time during which the disturbance is increased to a certain level followed by a dwell time in which the disturbance is at the certain level, the dwell time being followed, in turn, by a decay time in which the level of the disturbance is changed back to the initial level.

Figure 3:
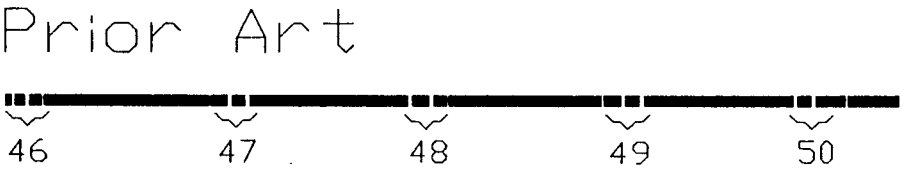
FIG. 3 shows a test line of ink printed with a prior art type of press operated at a relatively high speed to illustrate the streaking which the present invention is designed to overcome.
Figure 4:
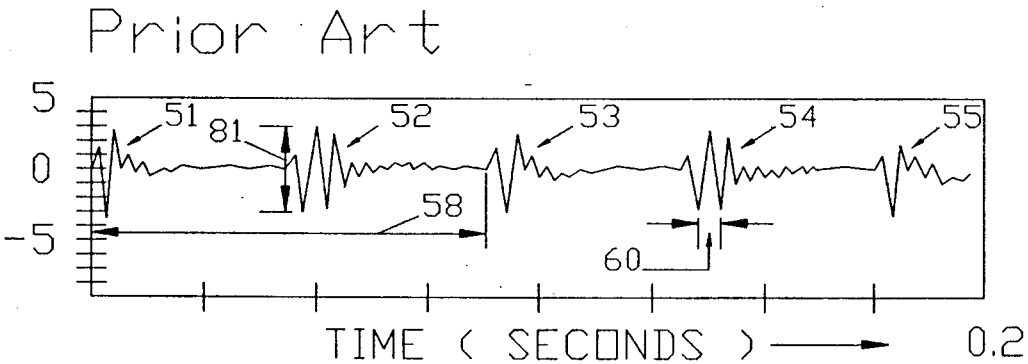
FIG. 4 is an illustrative waveform of cylinder oscillations of the type produced when a prior art type of press is operated at a relatively high speed and which undesirably results in printing with streaks as shown in FIG. 3.

An oscillatory system is formed by the four cylinders 15, 16, 19 and 20 and associated bearing support structures. This system has a resonant frequency that is determined by the mass and compliance characteristics of the cylinders primarily and is typically 300 Hertz or less in the case of printing cylinder systems. The gap disturbances which cause oscillations of this system are kept at a sufficiently low level, then streaking will not occur. As illustrated in FIGS. 3 and 4, streaks are produced by a press of conventional design operated at a high press speed of 40,000 cylinder revolutions per hour, when a prior conventional blanket securing arrangement is used in which ends of blankets and plates are captivated in lockup recesses by conventional lockup mechanisms with a small gap. In FIG. 3 a test line of ink extends in the direction of travel of the paper and would be a continuous black line if the gap disturbance were below a certain streaking disturbance threshold. However, there are five spaced groups 46–50 of ink discontinuities. Each group includes a plurality of such discontinuities and each discontinuity may be either a complete or a partial discontinuity so as to be either white or grey in the case of black ink. In printing of actual text and pictorial materials, streaks are produced which extend in transverse relation to the direction of paper travel and in spaced parallel relation to one another.

FIG. 4 illustrates the waveform over time of cylinder oscillations which cause the production of discontinuities as depicted in FIG. 3 when the press is operated at a speed of approximately 40,000 cylinder revolutions per hour. Five trains 51–55 of oscillations are shown, respectively corresponding to the five groups of ink discontinuities 46–50 of FIG. 3. Two trains of oscillations are produced during each complete rotation of a blanket cylinders. The illustrated trains 51, 53 and 55 are produced as a result of interfaces of the blanket cylinder securing arrangement with the paper and trains 52 and 54 are produced in 180 degree phase relation, when the securing means of the blanket cylinders interface with the securing means of the plate cylinders. Thus the time indicated by line 58 corresponds to one complete rotation of a blanket cylinder.

Typically, the oscillations build up to a maximum and then trail off, ink discontinuities being produced when the amplitude of the oscillations in one direction exceeds a certain threshold value. By measuring the time between consecutive negative or positive peaks, as indicated at 60, the approximate resonant frequency can be determined. By inversing the time period 60, a frequency of about 250 Hertz is determined in the illustrative case of FIG. 4.

Figure 5:
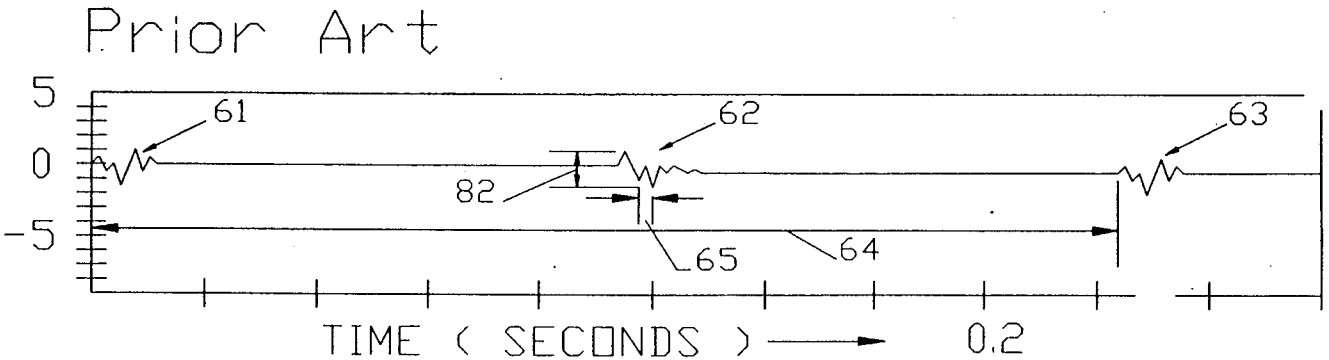
FIG. 5 is an illustrative waveform of cylinder oscillations produced when the same prior art type of press which produced the waveform of FIG. 4 at relatively high speed is operated at a relatively low speed.

FIG. 5 is a waveform of cylinder oscillations which result from operation of the same press as used in producing the waveform of FIG. 4 but which is operated at a lower speed, such as 15,000 cylinder revolutions per hour. Three trains of oscillations 61–63 are shown which respectively correspond to trains 51–53 but which are of reduced amplitude, such that they do not exceed a threshold value at which ink discontinuities and streaking would be produced. The time for one complete rotation, indicated by reference numeral 64, is longer than the time 58 in porportion to the reduction in speed, but the time between consecutive peaks of one polarity in a train, indicated by reference numeral 65, is the same since it is determined by the natural resonant frequency of the cylinder.

Figure 6:
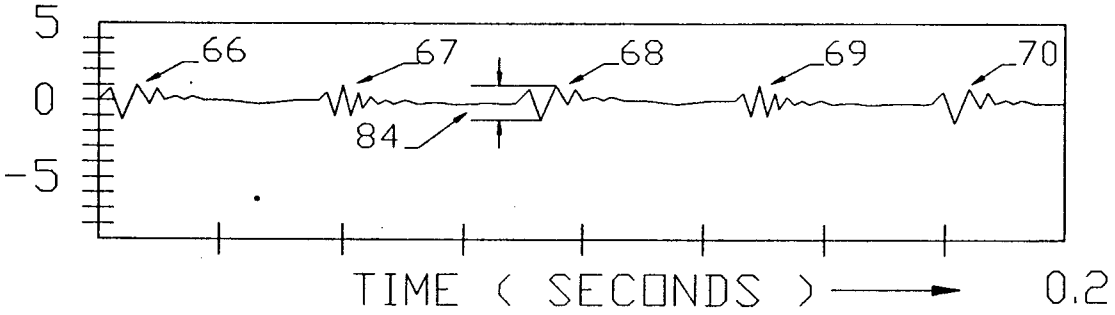
FIGS. 6 and 7 are illustrative waveforms of oscillations produced with a press constructed and operated with a pair of blanket cylinders of the present invention at the relatively high speeds and low speeds associated with the waveforms of FIGS. 4 and 5, respectively.
Figure 7:
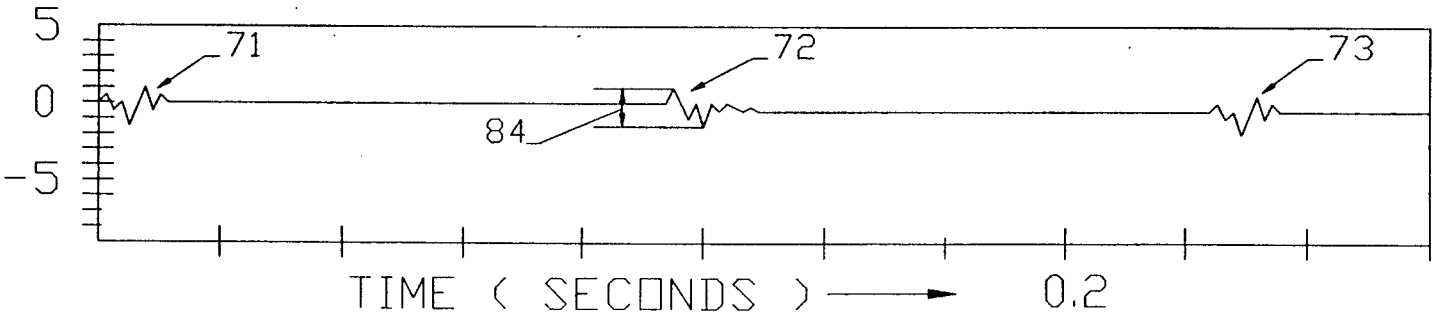

FIGS. 6 and 7 respectively correspond to FIGS. 4 and 5 but illustrated the form of cylinder oscillations produced with blanket securing arrangements of the invention and with press speeds of 40,000 and 15,000 cylinder revolutions per hour. In both cases, the amplitudes of the oscillations are less than a threshold value at which streaking would occur. Thus, in FIG. 6, trains 66–70 respectively correspond to trains 51–55 of FIG. 4 but are of greatly reduced double amplitude 83. Trains 71–73 of FIG. 7 respectively correspond to trains 61–63 of FIG. 5 and have double amplitude 84.which is about the same but also below a threshold value at which streaking occurs.

In keeping with this invention, an analyses generally applicable to the response of oscillatory systems to pulse-like disturbances is applied to printing press systems to determine the gap size needed to obtain stable, reliable and streak-free operation at high press speeds on the order of speeds of 40,000 cylinder revolutions per hour or higher. Speeds expressed in terms of cylinder revolutions per hour are set forth herein only because it is a commonly applied standard. Such speeds can be equated to a linear speed of paper movement, if desired. For example, with a cylinder diameter of approximately 7.25 inches, speeds of 15,000 and 40,000 cylinder revolutions per hour respectively correspond to speeds of about 95 and 253 inches per second.

The invention is based upon an analysis of press operations, theories related thereto and experimental results which are set forth in detail to develop guidelines for use in practical application of the invention to obtain optimum results. In particular, it is recognized that the response spectra of oscillatory systems under the influence of pulse-like disturbances are governed by the ratio of a characteristic time associated with the disturbing event and the natural period of the oscillator. In the case of coacting printing cylinders with surface discontinuities, it is found that the critical response spectrum is that of the residual amplitude of vibration following the end of the disturbance, in other words, the maximum displacement of the cylinder that occurs during the time when ink transfer is supposed to occur.

An oscillation-inducing disturbance can be described with three characteristic times: the rise time, the dwell time and the decay time. The rise time is the time period from the onset of the disturbance to the attainment of the disturbance maximum, and in printing presses as disclosed herein, it is initiated in response to an initial reduction of pressure. The time duration of the maximum disturbance level is the dwell time, which may be finite or zero. The decay time is the duration of time from when the disturbance begins to fall from the maximum level to the end of the disturbance.

In keeping with the invention, certain parameters must be determined in order to chose the correct gap size. In a printing press, each of such times is determined by dividing the circumferential cylinder length of travel over which the corresponding rise, dwell or decay occurs by the linear surface velocity of the cylinder. The natural period of a cylinder is the reciprocal of its natural frequency as determined by its mass and stiffness or compliance. It can be determined by measuring the time between consecutive peaks in the oscillatory trains, as indicated in FIGS. 4–7, or by any desired equivalent means. The ratio of each characteristic time associated with the disturbance and the natural period of the cylinder can then be expressed for printing cylinders as the product of a circumferential length and the cylinder natural frequency divided by the linear surface velocity of the cylinder. The latter is usually referred to as press speed. All of these factors are deterministic for a particular press design and operating condition.

The residual amplitude spectrum of cylinder vibration following the disturbance imparted by a surface discontinuity is determined mathematically. If it is assumed that the maximum level of the disturbance is unity and that the rise and decay events are symmetric with cycloidal shapes, the governing equation is equation (1) as follows:

$$X_R = \frac{v}{\pi w l} \frac{1}{1-\left(\frac{wl}{v}\right)} \left[\cos\pi\frac{wd}{v} - \cos\pi\left(\frac{2wl}{v}+\frac{wd}{v}\right)\right] \quad (1)$$

where $X_R$=residual cylinder response for a disturbance of unit magnitude;

V=linear surface velocity of cylinder;

w=cylinder natural frequency in bending;

l=circumferential length from onset to maximum level or from maximum disturbance level to end of disturbance; and d=circumferential length at maximum disturbance level.

The design parameters of a two-page wide, one-page around newspaper printing press will be used as an example to explain the principles of the invention and to facilitate application of the invention in practice. Such a press, e.g., the Goss Community manufactured by Rockwell International, is known to produce streak free printing at a press speed that yields 15,000 newspapers per hour. It is also known that at a press speed corresponding to 40,000 newspapers per hour streaks are present. FIGS. 3, 4 and 5 illustrate results obtained with such a press.

A measure of performance based thereon can be defined by equation (2) as follows:

$$P = \frac{X_R \text{ at 40,000 newspapers per hour}}{X_R \text{ at 15,000 newspapers per hour}} \quad (2)$$

where P is the measure of performance.

When P is greater than 1.0, the response of the cylinder to the disturbance imparted by the surface discontinuity is greater at 40,000 newspapers per hour than at 15,000 newspapers per hour indicating a tendency for performance deterioration at the higher speed. When P is equal to or less than 1.0, the indication is that the higher speed will not result in performance deterioration.

Substitution of equation (1) into equation (2) permits the measure of performance to be expressed as a function of the press design parameters. The results of such a substitution are shown graphically in FIG. 8.

Figure 8:
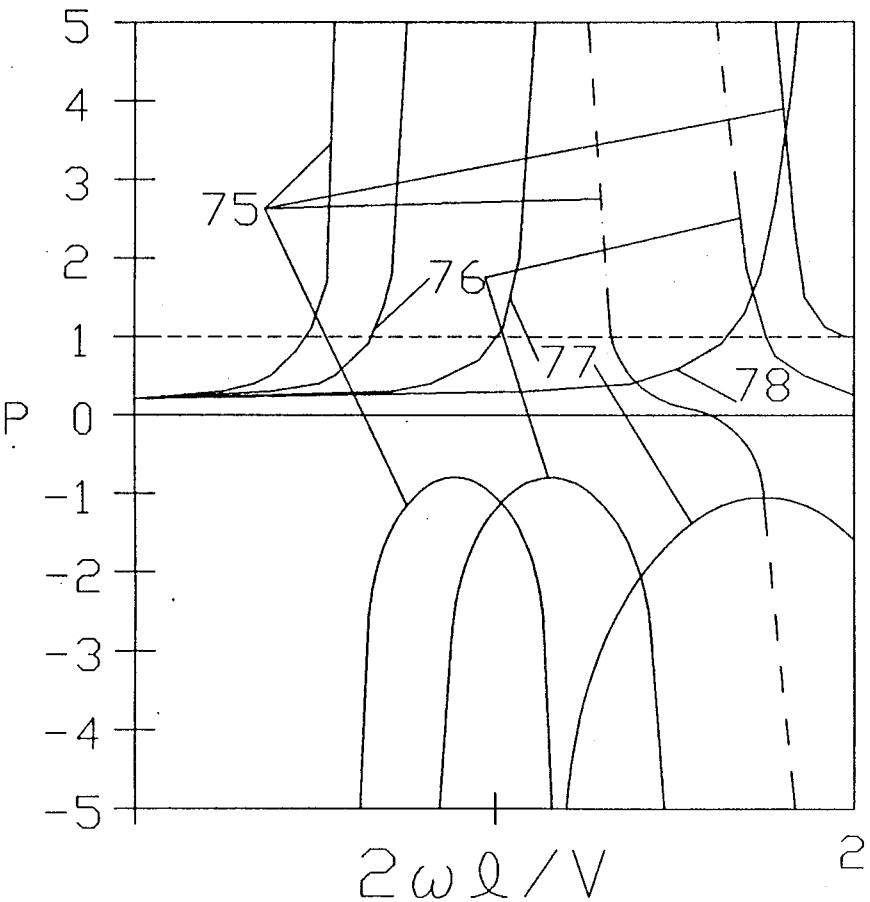
FIG. 8 is a graph showing the relationship of a measure of performance to a velocity related parameter at various dwell angle parameters as determined in accordance with the present invention.

FIG. 8 shows how the measure of performance P varies with various constant dwell ratios, the dwell ratio being defined as d/2l i.e. the ratio of circumferential cylinder length during which the disturbance is in dwell to a value equal to the sum of the circumferential cylinder lengths of disturbance rise and decay. The absicssa of FIG. 8, is $$\frac{2wl}{v},$$

i.e. the ratio of the sum of the rise and decay times of the disturbance at a press speed of 15,000 newspapers per hour and the natural period of the cylinder. Curves 75, 76, 77 and 78 of FIG. 8 respectively correspond to dwell ratios of 1.2, 0.8, 0.4 and 0 and are plotted over abscissa values of from zero to two.

Examination of FIG. 8 shows that parameters can be selected which will cause the cylinder response at a speed of 40,000 newspapers per hour to be either greater or less than that at 15,000 newspapers per hour. For example, with a ratio of 1.2 as represented by curve 75, the performance measure P rises from a value of about 0.38 toward an infinite positive value and then rises from an infinite negative value to a value of about −1. It then decreases toward an infinite negative value and then decreases from an infinite positive value toward 0. Thus, the performance measure P is unity or less at abscissa values of about 0.4 or less, at an abscissa value of about 0.85 and in a range of abscissa values from about 1.3 to about 1.6. It is found that the type of behavior as depicted graphically in FIG. 8 does in fact correspond with the actual behavior of printing cylinders. Thus, it is seen with this analysis that printing cylinder arrangements and methods are provided for finite surface discontinuities on the cylinders which, if they are the correct size, overcome problems with conventional designs that are manifested in performance deterioration as press speeds are increased.

As aforementioned, FIGS. 4 and 5 show the time dependent response of a cylinder equipped with a blanket securing mechanism of conventional design. In such a mechanism the surface of the cylinder is discontinuous for a length of approximately five-eighths of an inch. The circumferential length of the line of contact between the blanket cylinder and the coacting plate cylinder is approximately three-eighths of an inch, so it can be assumed that the two cylinders begin to move together as soon as discontinuity starts and continue to do so until the arriving edge at the end of the discontinuity is encountered. At this time the cylinders begin to move apart. Thus it can be assumed that there is no period of dwell for such discontinuity.

Taking the maximum peak-to-peak response values from FIG. 4 that correspond to the disturbance occurring between the plate and blanket cylinders, it is found that P=1.9. The natural period of the cylinder can be found by measuring the time between successive cycles of oscillation of the cylinder as shown in FIG. 4. With a total disturbance duration time at 15,000 newspapers per hour corresponding to five-eighths of an inch along the circumference of the cylinder, the abscissa value of the experimental condition is calculated to be 1.54. Comparing the peak-to-peak value 81 of strain variations at 40,000 newspapers per hour in FIG. 4 with the peak-to-peak value 82 of strain variations at 15,000 newspapers per hour as in FIG. 5 gives a performance measure P of about 1.9 as the experimental result at an abscissa value of 1.54 . This experimental result is somewhat higher than that indicated by the no dwell curve 78 of FIG. 8, but it is sufficiently close to substantiate the validity of the curves of FIG. 8 and the formulas from which they are derived.

FIG. 8 indicates that in order to reduce the measure of performance to unity or less, the values of the design parameters must be such that, with no dwell, the sum of the rise and decay times of the disturbance is equal to or less than 130 percent of the natural period of the cylinder. If accomplishing this introduces a dwell in the disturbance, a greater reduction in these times is required, in proportion to the amount of the dwell.

From FIG. 8, it can been seen that theoretically an acceptable measure of performance could be attained by selecting the design parameters, so that the operating condition is at or near one of the zero crossing points of the performance curves, thus avoiding the necessity for reducing the rise and decay times. However, in order to accomplish this, the introduction of a dwell time that is relatively large compared to the rise and decay times is required. Accordingly, in general this is not a desirable alternative because the resulting circumferential length during which printing cannot occur may be unacceptably large. Therefore the preferred approach is to confine the selection of parameters to keep the operating condition in a range that falls to the left of the first intersection of a performance curve with the unity value of the measure of performance.

Using the preferred approach, the cylinders in the press from which the experimental results shown in FIGS. 3–5 were acquired and which had a slot in the cylinder in which the ends of the blankets were secured, were replaced with blanket cylinder assemblies of the present invention with gaps 43 and 44 and of 0.1875 inch between the opposite ends of the blankets 13 and 14. This gap was selected to be essentially equal to the circumferential length of the line of contact between the coacting cylinders. It is assumed that under these conditions the onset of the disturbance occurs where the stress distribution within the blanket begins to change as a result of the proximity of the free end of the blanket to the area of force application. This proximity is approximately equal to the thickness of the material under stress. In this case, the blanket thickness was 0.076 inches and, thus, the stress distribution in the blanket continues to change until the end of the blanket passes the line of contact. The reverse situation occurs as the leading end of the blanket encounters the line of contact.

Under these conditions the nature of the disturbance is characterized as follows:

(1) The rise time of the disturbance is characterized by a circumferential length equal to the thickness of the blanket, i.e., 0.076 inches.

(2) The dwell time of the disturbance is characterized by a circumferential length equal to the gap between the ends of the blankets, i.e., 0.1875 inches.

(3) The decay time of the disturbance is characterized by a circumferential length equal to the thickness of the blanket, i.e., 0.076 inches.

The time dependent response of a cylinder so configured and operating at press speeds corresponding to 40,000 and 15,000 newspapers per hour is shown in FIGS. 6 and 7. The dwell ratio is calculated to be 0.1875b divided by two times 0.076, or 1.21, while the abscissa value is calculated to be approximately 0.4. The predicted value of the performance measure P in this case is about 0.8 and the experimental value, as determined from comparison of the peak amplitudes, as indicated by reference numerals 83 and 84 in FIGS. 6 and 7 correlated to within five percent of the predicted value.

Figure 9:
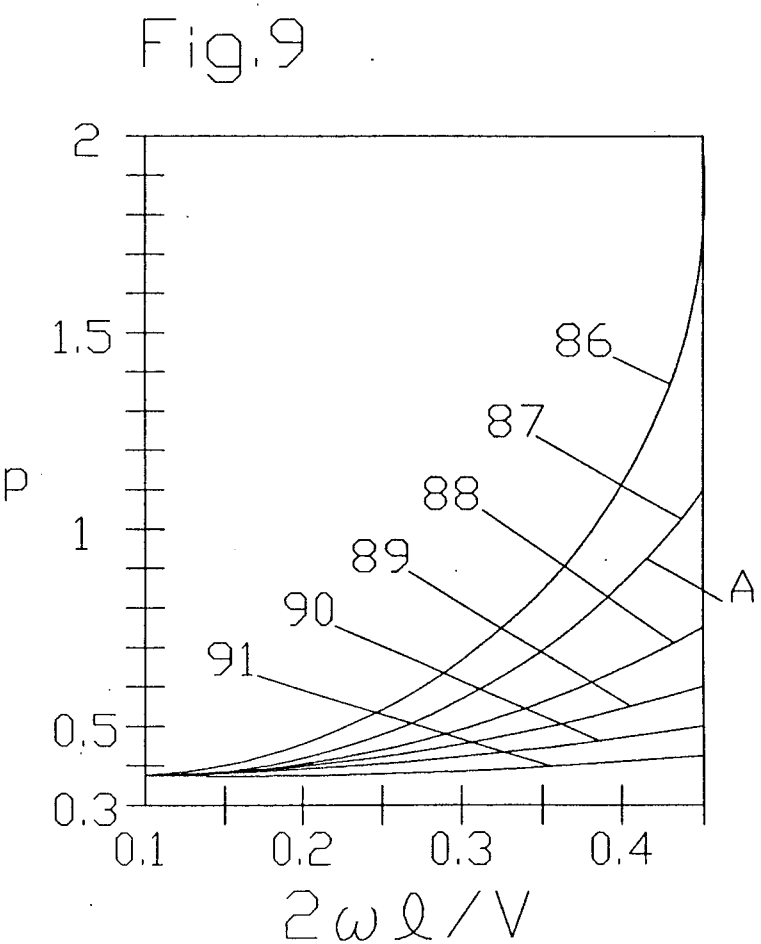
FIG. 9 is a graph similar to FIG. 8 but including a smaller range of velocity related parameter values.

Predicted response curves such as those of FIG. 8 are plotted for abscissa values from 0 to about 0.45 in FIG. 9 in which curves 86, 87, 88, 89, 90 and 91 respectively correspond to dwell ratios of 1.4, 1.2, 1.0, 0.8, 0.6 and 0.4. The experimental result determined from FIG. 6 and the previously stated characteristic times is shown as point A.

It is thus clear from the above that a method is provided for operation of cylinders in offset lithographic printing presses which can be used to specify a particular gap size in relation to the cylinder size (and therefore natural frequency) and other parameters and printing seeds required for a given application that eliminates the speed dependent deterioration of printing quality characteristic of conventional cylinder designs. Allowing for such a gap offers major advantages in the practical use of the equipment as compared to concepts that are intended to eliminate any gap whatsoever.

Two of the critical parameters involved in the application of this method are the rise or decay times of the disturbance which results from the presence of a surface discontinuity or gap. If these times are sufficiently small, the press performance at a higher speed, as measured by the presence or absence of streaking, will be better than or equal to the press performance at a lower speed. Sufficiency in this sense is a function of the ratio of the dwell time to the sum of the rise and decay times of the disturbance.

A third critical parameter involved in the application of this method is the natural frequency of the cylinder in bending. Those familiar with the theory of vibrations will understand that this frequency is primarily determined by the diameter and length of the cylinder and thus by the size of the product to be printed as determined by image repeat length and web width. It has been shown in the preceding that the effect of cylinder natural frequency on the measure of performance parallels the effect of the sum of the rise and decay times of the disturbance.

To provide practical guidelines, it is noted that the thickness of offset lithographic blankets are typically 0.085 inches or less. Mounting the blankets on a cylinder so there is a stress-free boundary condition on the leading and trailing ends will fix the rise and decay times of the imparted disturbance at values which are directly proportioned to this thickness. The natural frequency of printing cylinders is typically 300 Hertz or less. Therefore, if a reference press speed is taken to be 15,000 newspapers per hour, the ratio of the sum of the rise and decay times of a disturbance and the natural period of a cylinder will be 0.5 or less when the principles taught herein are applied. With this value a gap between the ends of a blanket that is approximately equal to twice the blanket thickness can be allowed, and no speed dependent deterioration of performance as defined herein will occur.

It will be understood that modifications and variations may be effected without departing from the spirit and scope of the novel concepts of the invention as set forth in the appended claims. Specifically, it should be appreciated that now that it is shown analytically that there is a proper gap size which will eliminate streaking at high press speeds, the correct gap size can also be determined experimentally.

I claim:

1. A blanket cylinder assembly, comprising:

a cylinder having a natural bending frequency;

a blanket with a pair of opposite ends and a preselected thickness; and means for mounting the blanket wrapped around the cylinder with a stress-free boundary condition at the opposite ends with a preselected gap therebetween, a stress-free boundary condition at the opposite ends causing the rise and decay times of gap disturbances associated with the gap to be substantially determined by said thickness of the blanket, and said gap having a dimension significantly greater than the thickness to provide a response level to gap disturbances at a preselected relatively high speed of a range of speeds which is less than a threshold speed at which a threshold response level is produced at which streaking is caused.

2. The blanket cylinder assembly of claim 1 in which said gap dimension is on the order of twice the thickness to provide a substantially uniform residual response for gap disturbances over the range of rotary speeds which is below said threshold response level.

3. The blanket assembly of claim 2 in which the range of speeds is on the order of 15,000 and 40,000 cylinder revolutions per hour.

4. The blanket assembly of claim in which said relatively high speed is 40,000 cylinder revolutions per hour and said gap dimension is approximately 0.1875 inch for a blanket thickness of approximately 0.076 inch and a natural bending frequency of approximately three hundred Hertz.

5. The blanket cylinder assembly of claim 1 in which said mounting means includes a pair of members respectively carried by the cylinder and the blanket which are magnetically attracted to each other.

6. The blanket cylinder assembly of claim 5 in which one of said pair of members is a permanent magnet.

7. The blanket cylinder assembly of claim 6 in which the other of said members is a portion of the blanket adjacent the ends made of ferromagnetic material.

8. The blanket cylinder assembly of claim 6 in which said permanent magnet is carried by the cylinder flush with a cylinder surface thereof.

9. The blanket cylinder assembly of claim 8 in which said cylinder has a surface of nonmagnetic material, and means for mounting a permanent magnet flush with said surface including a pocket in said cylindrical surface within which said permanent magnet is received.

10. The blanket cylinder assembly of claim 9 in which said pocket has a liner of nonmagnetic material interposed between the permanent magnet and the cylinder.

11. The blanket cylinder assembly of claim 5 in which one of said members is a backing plate of said blanket with at least a portion thereof adjacent the ends made of ferromagnetic material.

12. The blanket cylinder assembly of claim 5 in which said mounting means includes a plurality of pairs of members respectively carried by the cylinder and blanket which are magnetically attracted to each other.

13. The blanket cylinder assembly of claim 12 in which said plurality of pairs of members are substantially aligned with each other along the elongate gap at both ends of the blanket.

14. The blanket cylinder assembly of claim 1 in which said blanket, at least adjacent the ends, has a pair of plys, an outer relatively resilient ply and an inner ply of magnetic material.

15. The blanket cylinder assembly of claim 14 in which said inner ply is coextensive with the outer play.

16. The blanket cylinder assembly of claim 14 in which said inner ply is magnetic stainless steel.

17. The blanket cylinder assembly of claim 1 in which said preselected gap has a dimension to produce a performance measure P of not greater than unity in which said performance measure P is the ratio of the residual cylinder response for a disturbance of unit magnitude at a given relatively high speed to that at a relatively low speed.

18. The blanket cylinder assembly of claim 17 in which the residual cylinder response for a disturbance of unit magnitude is defined by the equation:

$$X_R = \frac{v}{\pi w l} \frac{1}{1 - \left(\frac{wl}{v}\right)} \left[ \cos\pi \frac{wd}{v} - \cos\pi \left( \frac{2wl}{v} + \frac{wd}{v} \right) \right]$$

where $X_R$=residual cylinder response for a disturbance of unit magnitude;

V=linear surface velocity of cylinder;

w=cylinder natural frequency in bending;

l=circumferential length from onset to maximum level or from maximum disturbance level to end of disturbance; and d=circumferential length at maximum disturbance level;

and wherein l is a function of blanket thickness and the type of blanket support and d is a function of the width of said gap.

19. The blanket cylinder assembly of claim 1 in combination with another coacting cylinder having an elongate area of contact therewith with a circumferential length and in which said gap is substantially equal to the circumferential length.

20. The blanket cylinder assembly of claim 1 in which said blanket has a thickness and said gap is preselected to be no less than twice the thickness.

21. The blanket cylinder assembly of claim 1 in which said gap is preselected to cause the rise and decay times of the disturbances caused by the gap to have a value not greater than 130% of the sum of inverse of the natural bending frequency of the cylinder plus the dwell time during which the magnitude of the disturbance is at the level reached at the end of the rise time from zero magnitude.

22. The blanket cylinder of claim 1 in which said relative high speed is on the order of 40,000 cylinder revolutions per hour.

23. A method of making a blanket cylinder for a printing press operable at a preselected relatively high speed, comprising the steps of:

providing a cylinder with a circumference of given size and a natural frequency in bending;

providing a blanket with a given thickness and a length measured between a pair of opposite ends thereof which is less than the circumference of the cylinder by an amount to produce, when wrapped around the cylinder, a corresponding gap between the opposite ends of a size which is selected based in part on (a) said thickness, (b) the forces securing the blanket to the cylinder at said opposite ends and (c) said natural frequency to achieve a response level to gap disturbances that is less than a given threshold response level which causes streaking at said speed; and securing the blanket wrapped around said cylinder with the preselected gap.

24. The method of claim 23 in which said step of securing includes the step of securing the blanket to the cylinder so that the forces securing the blanket to the cylinder provide stress free boundary conditions on the opposite ends of the blanket.

25. The method of claim 24 in which said preselected size is preselected to be as large as twice the thickness for a natural frequency of three hundred Hertz or less.

26. The method of claim 23 in which said step of securing the blanket to the cylinder includes the steps of providing the cylinder with a first magnetic element;

providing the blanket with a magnetic element which is magnetically attracted to the magnetic element of the cylinder; and wrapping the blanket around the cylinder to align the magnetic element of the blanket and cylinder adjacent one another in mutual holding attraction.

27. The method of claim 26 in which a magnetic element of the blanket is provided at each of the opposite ends of the blanket.

28. The method of claim 23 in which the natural frequency response is determined empirically.

29. The method of claim 23 in which the gap size is preselected so that the total of the rise and decay times of the disturbance caused by the gap is substantially not greater than one hundred thirty percent of a natural period of the cylinder corresponding to the natural frequency for zero dwell time conditions.

30. The method of claim 23 in which the gap size is selected to be approximately equal to the circumferential length of a line of contact which would exist between two of the blanket cylinder assemblies coacting with one another.

31. The method of claim 23 in which a proportional gap size of approximately 0.1875 inch is selected for a blanket thickness of approximately 0.076 inches and a natural frequency of approximately three hundred Hertz when the forces securing the blanket to the cylinder provide a stress free boundary condition on the opposite ends of the blanket.

32. The method of claim 23 in which the gap size is selected based in part on all of the (a) thickness (b) the securing forces and (c) the natural frequency.

33. The method of claim 23 in which the gap size is selected to produce a measure of performance which is not substantially greater than one where the measure of performance is defined as the ratio of the residual cylinder response of the cylinder assembly to a disturbance of unitary value at a speed of at least 40,000 cylinder revolutions per hour to the residual cylinder response to a disturbance of unitary value at a speed of 15,000 cylinder revolutions per hour.

34. The method of claim 31 in which the residual cylinder response is defined by the equation:

$$X_R = \frac{v}{\pi w l} \frac{1}{1 - \left(\frac{wl}{v}\right)} \left[ \cos\pi \frac{wd}{v} - \cos\pi \left( \frac{2wl}{v} + \frac{wd}{v} \right) \right]$$

where $X_R$=residual cylinder response for a disturbance of unit magnitude;

V=linear surface velocity of cylinder;

w=cylinder natural frequency in bending;

l=circumferential length from onset to maximum level or from maximum disturbance level to end of disturbance; and d=circumferential length at maximum disturbance level;

and wherein l is a function of blanket thickness and the type of blanket support and d is a function of the width of said gap.

* * * * *